US007256343B2

(12) United States Patent
Brubaker et al.

(10) Patent No.: US 7,256,343 B2
(45) Date of Patent: Aug. 14, 2007

(54) INTERCHANGABLE PRE AMP MODULE FOR AN ELECTRONIC STRING INSTRUMENT

(76) Inventors: Kevin Brubaker, 250 Chartley Dr., Reisterstown, MD (US) 21136; David J. De Marco, 6204 Everall Ave., Baltimore, MD (US) 21206

( * ) Notice: Subject to any disclaimer, the term of this patent is extended or adjusted under 35 U.S.C. 154(b) by 153 days.

(21) Appl. No.: 10/916,488

(22) Filed: Aug. 12, 2004

(65) Prior Publication Data

US 2006/0032365 A1 Feb. 16, 2006

(51) Int. Cl.
*G10H 3/00* (2006.01)
*G10H 1/32* (2006.01)

(52) U.S. Cl. ..... 84/743; 84/267; 84/291; 84/723; 84/726

(58) Field of Classification Search ..... 84/743, 84/723, 726, 291, 267, 727, 745, 293, 725
See application file for complete search history.

(56) References Cited

U.S. PATENT DOCUMENTS 4,254,683 A * 3/1981 Nulman ..... 84/727
4,433,603 A * 2/1984 Siminoff ..... 84/726
4,472,994 A * 9/1984 Armstrong ..... 84/726
5,052,269 A * 10/1991 Young, Jr. ..... 84/728
5,517,891 A * 5/1996 Sica ..... 84/453
5,637,823 A * 6/1997 Dodge ..... 84/743
6,043,422 A * 3/2000 Chapman ..... 84/723
6,051,773 A * 4/2000 Rose ..... 84/743
6,111,184 A * 8/2000 Cloud et al. ..... 84/723
6,188,005 B1 * 2/2001 White ..... 84/291
6,253,654 B1 * 7/2001 Mercurio ..... 84/267
6,649,817 B2 * 11/2003 Hartill ..... 84/267
6,781,050 B2 * 8/2004 Olvera et al. ..... 84/743
6,800,800 B1 * 10/2004 Giordano et al. ..... 84/726
6,911,590 B2 * 6/2005 Childress ..... 84/291
2002/0104424 A1 * 8/2002 Spalt ..... 84/291
2003/0164080 A1 * 9/2003 Childress ..... 84/291

* cited by examiner

*Primary Examiner*—Lincoln Donovan
*Assistant Examiner*—Christina Russell
(74) *Attorney, Agent, or Firm*—John S. Hale; Gipple & Hale

(57) ABSTRACT

An interchangeable modular insert for a electric stringed instrument is mounted in a cavity cut into the rear of the instrument. The rear insertion module provides rapid exchange of electronic components of different manufacturers. Placement of a module into the instrument automatically positions the module and electrically connects the same with the module being retained in the guitar body by a threaded fastener.

16 Claims, 4 Drawing Sheets

INTERCHANGABLE PRE AMP MODULE FOR AN ELECTRONIC STRING INSTRUMENT

RELATED APPLICATIONS

There are no related applications.

FIELD OF THE INVENTION

The present invention relates to the field of electric stringed instruments and, more particularly to an interchangeable, electronics-containing module which is fitted into an electronic stringed instrument body.

BACKGROUND OF THE INVENTION

Stringed instrument electronics are comprised of magnetic pickups arranged beneath the strings of guitars and like instruments, and other electronic components which facilitate obtaining qualities of tonality, loudness, reverberation and timbre. Potentiometers regulate tonal qualities and volume and switches regulate the electronic signal between pickups or different tonal qualities within the same pickup. Vibrations in the strings of a guitar induce electric signals in the coils of the pickup which are modified by switches and potentiometers and transmitted through the output wires from the guitar to an amplifier. Modification of musical sound utilizing different pickup designs and complementary electronic components can be achieved by the regrouping of pickups and electronic components.

Changes in styles of music and advances in pickup design and associated electronics, however, have spawned a large electronic music market with many manufacturers, each producing different electronics. Previously, there had been no way for guitar players to conveniently have available to them a choice between various sounds in a single instrument and the capability of repairing the electronics of same without leaving the guitar at the repair facilities. Guitarists have typically acquired numerous guitars, each with a particular electronic installation which produces distinct tonal qualities.

The exchange of guitar electronics in existing guitars generally requires technical assistance that is costly and time-consuming. Guitar players having technical expertise may exchange pickups and electronics themselves by removing the strings, unscrewing the casement for each pickup and electronics, installing the new pickups and/or electronics and rest ringing. Thus, each electronic component may be replaced individually and wired to the respective electronic connection.

U.S. Pat. No. 5,637,823 issued Jun. 10, 1997 is directed toward an interchangeable electronics module mounted to an electric stringed instrument. The guitar is formed with a cavity formed through the instrument body beneath the strings to house the pickups and other electronic components. The rear insertion modules provide rapid exchange and simultaneous regrouping of pickups and electronic components. Placement of a module into the instrument automatically positions the pickups beneath the strings, with the module being retained in the body by a flange formed in the instrument body. The module is removably secured in the instrument body by resiliently biased latches, which also function as spacers between the module and instrument body and connect the electronic components installed in the module to a grounding plate in the instrument body.

U.S. Pat. No. 6,043,422 issued Mar. 28, 2000 patent discloses a removable active pickup module, directed particularly to a bodiless stringed musical instrument and has a main enclosure machined from dense solid material to provide a complex of internal compartments. The module is configured with a six-sided, diagonally-elongated shape consistent with the appearance of The Chapman Stick®.

U.S. Pat. No. 5,767,432 issued Jun. 16, 1998 uses a removable pickup cassette mounted in a cavity formed in a solid body electric guitar.

U.S. Pat. No. 6,194,644 issued Feb. 27, 2001 discloses an electric guitar with two structurally independent components. A neck/tailpiece module is set into a docking recess in the body module. In operation, the two components are joined mechanically and electronically by an indexing pin and a wiring connector and are fastened by a single bolt. The structural independence of the two members makes possible the utilization of bodies which may be constructed of almost any shape, size or material.

Many of today's popular guitar body styles can be outfitted with suitable electronics only by having a separate configuration style for each body type. Furthermore since the electronics may produce different effects, many musicians will employ different electronics in an attempt to achieve the desired sound. When musicians are purchasing same, the musician will try out a number of different models of different manufacturers to determine which model produces the most desired effect.

For the foregoing reasons, there has been a need for a rear entry interchangeable electronics module for increased rapidity of electronic exchange, a module that would be placed into a cavity formed in the instrument body, containing pre amp and associated tone controls allowing easy exchange of the same with other modules of different manufacturers. Furthermore there is a need to preclude leaving the guitar with a repairman for repair or substituting components and to preclude requiring time consuming removal and replacement of parts for the guitar. Further, there has been a need for a rear insertion module which allows easy installation of the electronic components on the current market.

SUMMARY OF THE INVENTION

The present insertable module allows different electronic packages (other manufacturers pre amp-tone shaping and effects) to be used in the same musical string instrument. This would allow the player to be able to interchange pre amp systems quickly and test out different manufacturers (approximately 10 or more currently on the market) systems without having to go to the local repair person and have one permanently installed. With a single push of a button/release mechanism or removal of a fastening device, the module can be removed and the electronics of another of a different manufacturer can be installed in a matter of seconds. Also, any repairs or upgrades after purchase are made easier because all the electronics, pre amps, potentiometers and switches are contained in the unit and can be worked on outside and away from the instrument.

The present invention has been made in view of the above-described disadvantages associated with the known electric stringed instruments and has as an object to provide a rear entry modular instrument with an exchangeable electronics module.

It is another object of the present invention to provide a convenient and fast replacement of electronic components by the use of interchangeable modules.

It is a further object of the present invention to provide interchangeable electronic modules using electronic components of differing manufacturers which can be placed into the same electric stringed instrument body for purposes of comparing effects.

It is still further an object of the present invention to provide a module that is not an integral part of the structure of the instrument.

It is another object of the present invention to provide a module and instrument body construction which maintains the aesthetic appearance of the instrument.

It is yet another object of the present invention to provide a module which is easily fitted into an instrument body.

It is further an object of the present invention to provide a module which maintains the aesthetic and utilitarian qualities of the instrument.

The cavity cut into the rear surface of the instrument is of a shape and size to remove and receive a module which is preferably retained in the cavity by a base plate. Once installed, the module has a fixed connector allowing it to be connected to various pickups and volume control. Modules having different electronic components may be provided with an instrument to offer a musicians a choice between distinct selected sounds.

These and other objects, advantages, and novel features of the present invention will become apparent when considered with the teachings contained in the detailed disclosure which along with the accompanying drawings constitute a part of this specification and illustrate embodiments of the invention which together with the description serve to explain the principles of the invention.

DETAILED DESCRIPTION OF THE INVENTION

The preferred embodiment and best mode of the invention is shown in FIGS. 1 through 6. While the invention is described in connection with certain preferred embodiments, it is not intended that the present invention be so limited. On the contrary, it is intended to cover all alternatives, modifications, and equivalent arrangements as may be included within the spirit and scope of the invention as defined by the appended claims.

The present invention comprises a pre amp module used in electric stringed instruments including the electric guitar, the bass guitar, the electric mandolin and the like. For illustrational purposes only, the drawings and descriptions herein refer only to the bass guitar.

Figure 1:
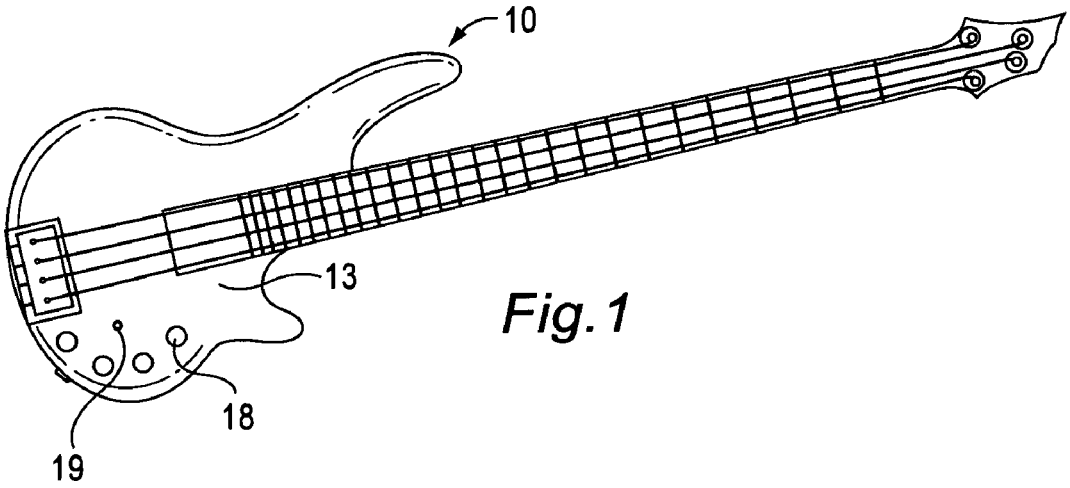
FIG. 1 is a plan view of a guitar used with the interchangeable electric guitar modular with the module removed.
Figure 2:
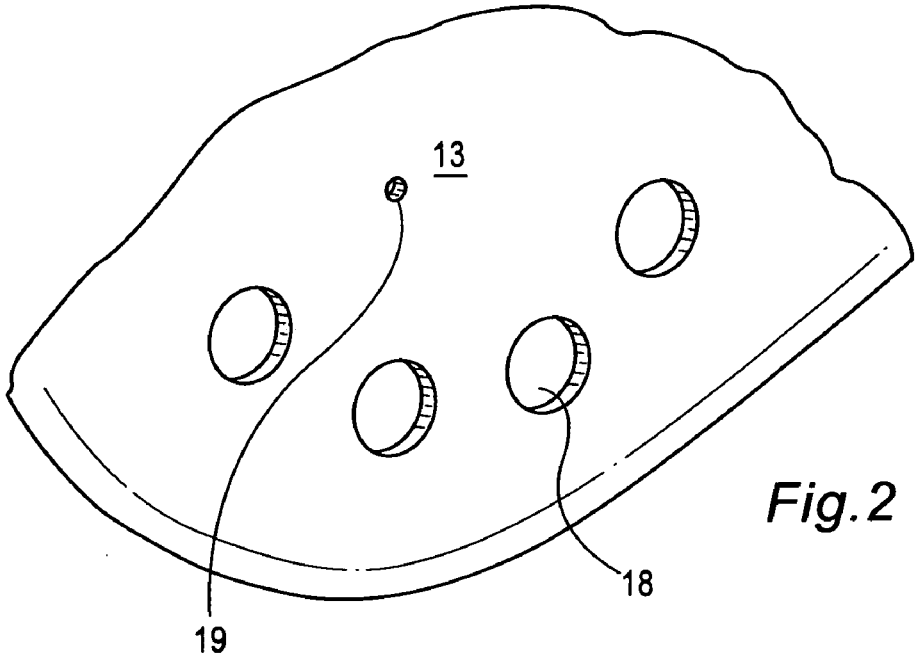
FIG. 2 is an exploded partial enlarged view of FIG. 1 showing the control knob holes cut into the body of the guitar.
Figure 3:
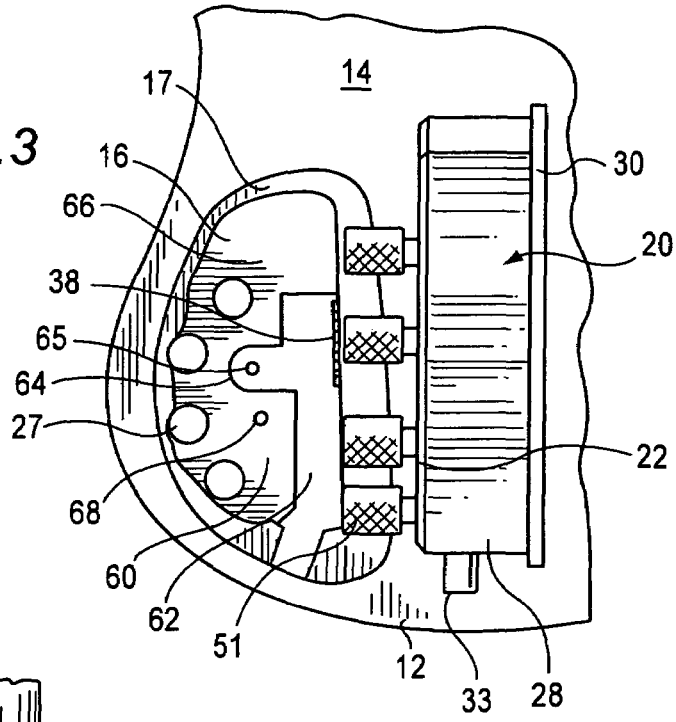
FIG. 3 is a enlarged partial bottom planar view of the guitar with the module placed in a side elevational view.
Figure 4:
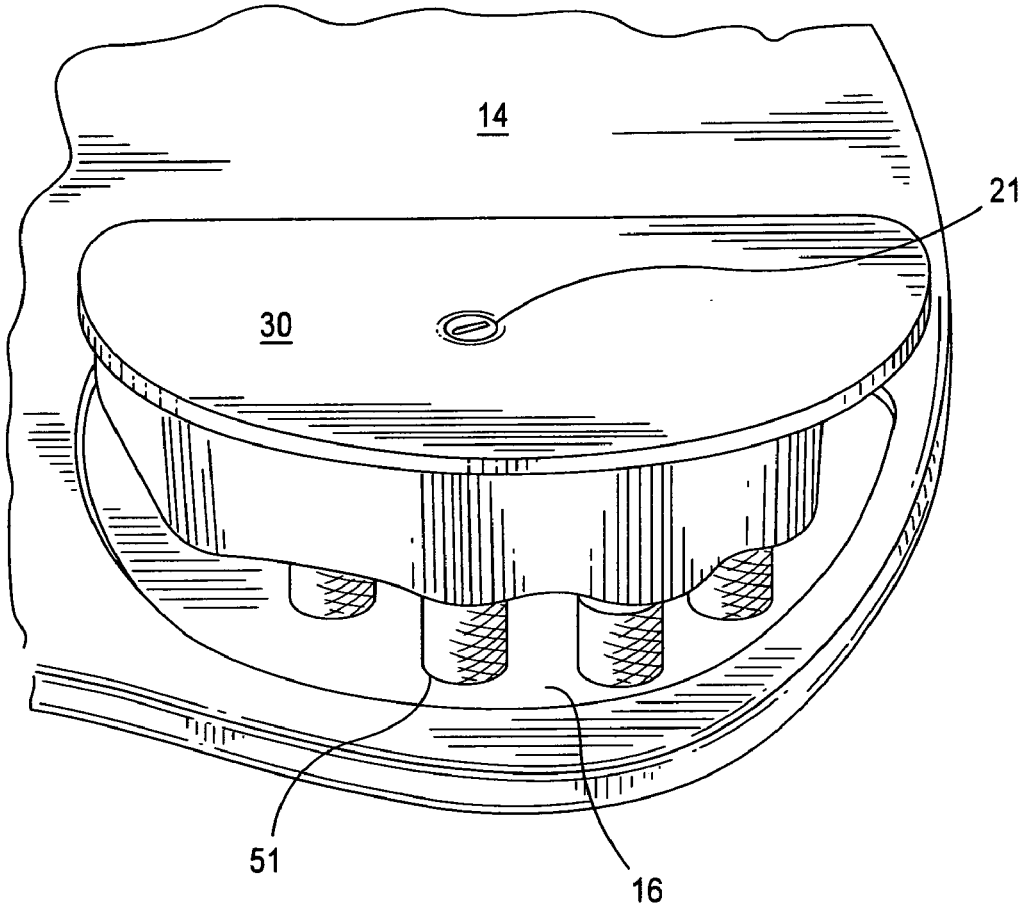
FIG. 4 is an enlarged perspective view of the module being installed in the cavity of the guitar body.

FIG. 1 illustrates an electric guitar 10 with the interchangeable module 20 located on the rear of the guitar. The guitar includes a plurality of metallic strings running from the head to the bridge assembly. The strings are located cooperatively with two or more pickups such that the pickups will detect vibrations into an electrical current for external amplification and other adjustments. The movement of the metal string in proximity to the pickup causes the pickup to generate a minute electrical signal which corresponds to the vibration of the related string, thus exhibiting the string characteristics such as pitch and the presentation of frequencies including harmonics. The guitar 10 comprises a guitar body 12 with a module cavity 16 having a side wall 17 preferably formed in the bottom of the instrument body as shown in FIGS. 3 and 4. A module 20 containing the associated electronic components including the pre amp is shown removed from the guitar body 12 in FIG. 6. The module 20 may be constructed of metal, plastic or any other suitable material such as wood, fiberglass, graphite and composite materials. The module 20 is inserted through the back face 14 of the guitar body 12 with the control knobs 51 for the pickup blend control, dual bank mid control, bass/treble control and volume/bypass switch electronics inserted through holes 18 cut in the guitar front face 13 and extending into the module cavity 16. The function and operation of these controls is well known to electric guitar players and will therefore not be described further. A support plate 60 is mounted to the guitar in cavity 16 as seen in FIG. 3. The support plate 60 can be glued to the guitar or mounted via fasteners which can take the form of posts, tabs, screws, or clips. The support plate 60 has a raised planar portion 62 with an arcuate projection 64 having a threaded, blind bore 65 and a lower planar portion 66 with a throughgoing aperture 68 axially aligned with guitar body aperture 19 cut through the front face 13.

Figure 5:
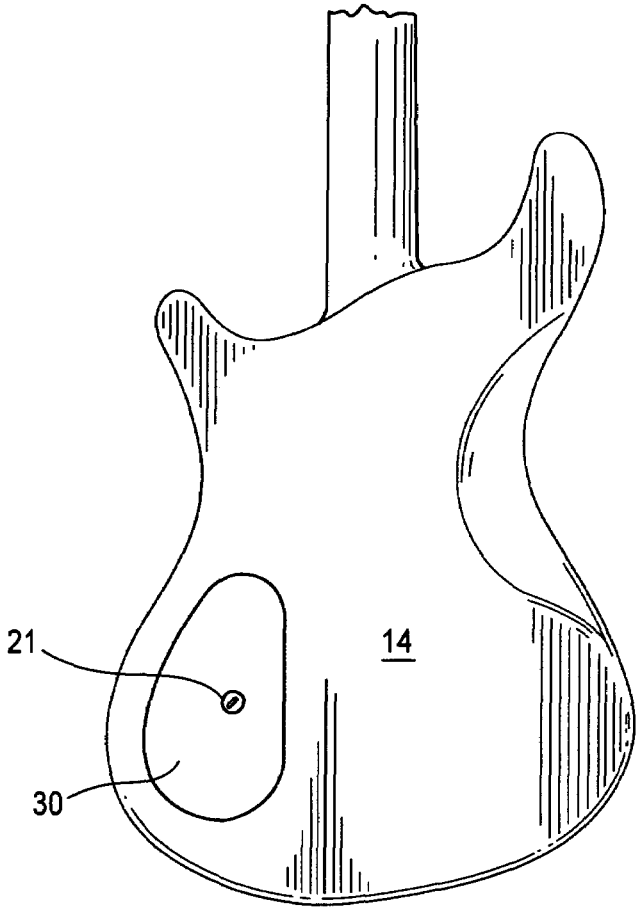
FIG. 5 is a bottom plan view of the guitar with the module installed and secured.
Figure 6:
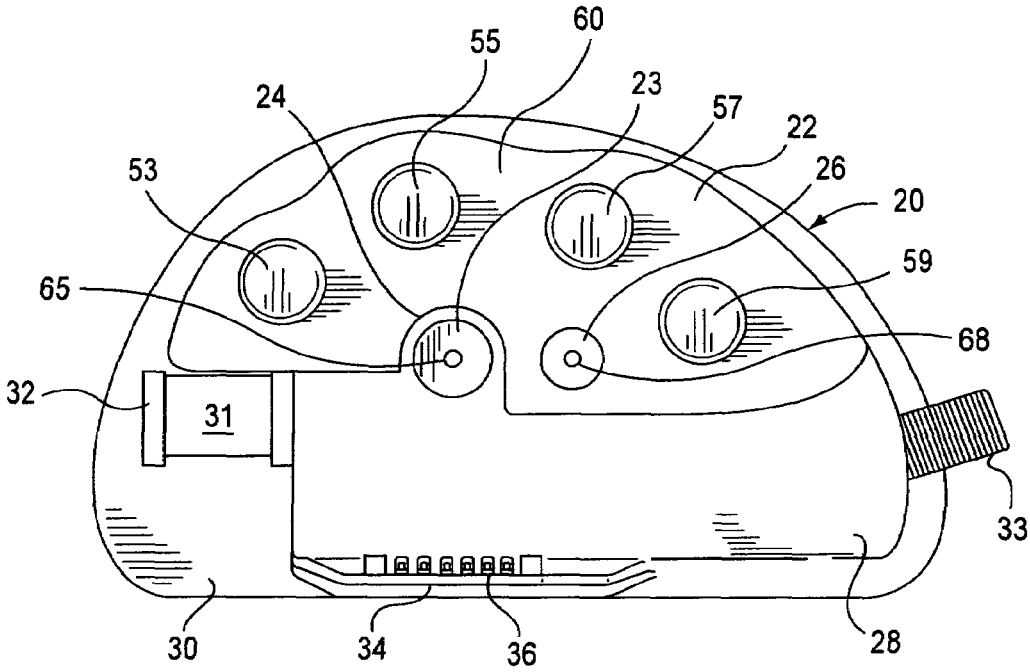
FIG. 6 is a top plan view of the module with cover.

The module 20 as shown in FIG. 6 is constructed with an arcuate shaped planar surfaced face or cover plate 22 which defines an arcuate recess 24 which acts as a keyway as it receives the arcuate projection 64 of the support plate. This aligns a threaded center mount boss 23 to blind bore 65 formed in the support plate 60 so that the module can be fastened to the support plate. A fastener 21 in the form of a screw is mounted into the threaded boss 23 as is shown in FIGS. 4 and 5 and screwed into blind bore 64. Additional support is provided by threaded bore 26 formed in the face plate 22 which upon insertion of the arcuate projection 64 is aligned with aperture 19 formed in the guitar front face 13 and threaded aperture 68 formed in support plate 60. A control electronics housing 28 covers the pre amp which is not shown but which is mounted to the support plate in a known manner and respective control electronics which are not shown as the same are well known in the art. A housing 28 can be mounted by screws to one or more bosses or posts extending from the base plate 30 or through the use of snap on retainer clips mounted on the base plate 30. The posts can be rectangular or cylindrical and have a threaded blind bore axially centered to receive a screw. The control electronics housing 28 is provided with side walls and is seated on base plate 30. The support plate 60 defines cutouts in the form of holes 27 which are aligned with holes 18 cut into the guitar to receive the knobs 51 for the control electronics. The cutouts 27 can also be in the form of recessed notches or curves if so desired.

The base plate 30 of the housing 28 has a battery holder 32 mounted thereto as seen in FIG. 6 so that the battery 31 is exposed and easily accessible. The battery leads are mounted inside the battery holder. A contact connector member 34 is formed in the side wall of the housing 28 to provide an electrical contact point for the inner electronics.

The battery holder 32 has positive and negative connectors which causes a battery shown in FIG. 6 to be electrically engaged when a battery is placed in the battery holder. The battery 31 which is commercially available, is inserted into the battery holder 32 to engage the conductors of the battery holder prior to insertion of the module 20 into the guitar cavity. A built in pre amp and required electronic component are mounted on the inside of the module by adhesive or brackets. The pre amp is of standard construction purchased off the shelf by one of a number of manufacturers well-known in the art. The connector member 34 is mounted to a side wall of the housing 28 but can be mounted to the base plate 30. The connector member 34 which is a male pin type connector has a series of slide pins 36 which are adapted to be mounted to the female/mate pin connector 38 mounted on the inside wall of cavity 16 as is shown in FIG. 3. The pin connector 34 is a 6-10 pin flat modular connector with extra connections for any possible switching arrangement, e.g., neck and bridge pick up phasing, coil selection, ground, jack, etc. The support plate 60 is provided with a plurality of cutouts or holes 38 through which the respective knob controls 53, 55, 57 and 59 for the control electronics extend. When the module 20 is mounted within the guitar cavity 16, the knobs controls 51 extend through holes 38 and guitar holes 18 cut through the front face of the guitar up past the upper surface of the guitar allowing easy adjustment of one or more of the various control electronics when the module is seated in the guitar body cavity. The housing can be snap fit in retainers mounted on the support plate 60. All the electronics, potentiometers, and switches are contained in the unit module so that the same can be removed from the guitar and worked on outside and away from the instrument. The electronics are standard off the shelf units available from a number of manufacturers currently used in electric stringed instruments.

The module 20 is inserted through the back of the guitar body 12 as depicted in FIGS. 3 and 4, and is maintained in position by the face plate 22, support plate 60, fastener 21 and a fastener inserted through hole 19 into the face plate. The module 20 houses the pre amp and battery, with wiring connecting the electronic control components, namely, the pickup blend control, the dual band mid control, the bass/treble control and the volume/bypass switch control to the housed pre amp. Wires and/or a cord can be run from the interior of the housing 28 outside of the module 20 through hollow stem 33. In accordance with the invention, each interchangeable module permits the regrouping of varying types of electronics and allows connection via a connector 34 to the selected switching arrangement.

The module 20 is held in the guitar body 12 by means a screw 21 which is threaded into threaded boss 23 and aperture 65 as is shown in FIGS. 3 and 6 and another screw which is threaded through aperture 19 and aperture 68 into threaded boss 26.

This construction enables the installation or servicing of different pickups and electronic components in any given module, if desired. For rapid exchange of pickups and electronic components, however, interchangeable modules, each having a different electronic installation is preferred. Thus, by having a single instrument and multiple modules, a variety of distinct sounds are achieved through the exchange of modules, and an infinite variety of combinations of pickups and electronics is provided.

The foregoing description is to be clearly understood as given by way of illustration and example only, the spirit and scope of this invention being defined by the appended claims and their equivalents.

The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present inventions defined by the following claims:

What is claimed is:

1. An electric stringed instrument with a modular component comprising:

an instrument body having a front face and a rear face and defining a cavity cut in said rear face; and a module comprising a housing removably secured to said instrument body, a pre amp, and control electronics for processing signals derived from remote pickups mounted to said housing, said module being seated in said cavity formed in said body opening through said rear face of said instrument body and secured to said stringed instrument by fastening means, adjustment knobs connected to said control electronics extend upward from said module outside of said housing and extend through apertures cut in said stringed instrument body front face.

2. The electric stringed instrument of claim 1 wherein said cavity includes a perimeter defining a shape and said module is of substantially the same shape of said cavity.

3. The electric stringed instrument of claim 1 comprising a plurality of removably insertable modules, each of which can be mounted in said cavity and which provide electronic components which are manufactured for guitars by different manufacturers.

4. The electric stringed instrument of claim 1, wherein said module has a fixed connector member secured thereto which allows electrical connection with pickups mounted in said guitar.

5. The electric stringed instrument of claim 4, wherein connector member has a plurality of pins ranging from 6 to 10 in number.

6. The electric stringed instrument of claim 5 wherein said connector member pins engage a mating connector member mounted on a wall of said instrument body cavity.

7. The electric stringed instrument of claim 1, wherein said module housing is composed of a material selected from the group consisting of wood, plastics, metals, fiberglass, graphite and composite materials.

8. The electric stringed instrument of claim 1, wherein the fastening means comprises a threaded fastener member mounted to said module and said a plate.

9. The electric stringed instrument of claim 1, wherein a cover plate is mounted to said housing, said cover plate being provided with cutouts allowing an adjustment knob of said electronic assemblies to extend therethrough.

10. An electric guitar comprising:

a guitar body having a front face and a rear face and defining a cavity cut into said rear face defining a shape which the same shape as a module adapted to be mounted in said guitar;

a support plate mounted to said guitar body in said cavity and a module mounted to said support plate;

said support plate defining a plurality of throughgoing apertures said module comprising a base plate, a housing mounted to said base plate, a battery holder mounted to said base plate, a connector member mounted on a wall of said housing, said connector member providing electronic communication with plurality of pickups and a volume control, a plurality of electronic control assemblies electronically connected to said connector member, each of said control assemblies including an adjustment knob which extends therefrom and extends through a support plate aperture, said module being removably insertable in said cavity through said rear face of said guitar body with said base plate being flush with a rear face of said guitar body.

11. The electric guitar of claim 10 wherein said support plate comprises a raised section forming a key and a lower section with a planar surface.

12. The electric guitar of claim 10 wherein a battery connector is mounted to said base plate.

13. The electric guitar of claim 10 wherein said connector member comprises a plurality of slide pins adapted to receive connections from a number of electronic leads located outside of said module.

14. An interchangable module for use with an electronic stringed instrument which is placed in a cavity formed in the rear of the electronic stringed instrument;

a support plate mounted in said cavity, said support plate defining a raised key means, a module mounted to said support plate;

said module comprising a base plate and a housing mounted to said base plate, a battery holder and a preamp mounted on said base plate, a connector member mounted on said base plate, said connector member providing electronic communication with plurality of pickups and volume control, said connector member being provided with a plurality of slide bars adapted to electronically connect and mate with a corresponding electrical connection member mounted to a wall of said cavity formed in said electronic stringed instrument, a plurality of electronic control assemblies enclosed by said housing, each of said electronic control assemblies including an adjustment knob which extends therefrom, said housing being provided with a cover member mounted thereto, said cover member being provided with cutouts allowing an adjustment knob of said electronic control assemblies to extend therethrough. said cover member defining a recess which receives said support plate key means, said module being removably insertable in said cavity face with said base plate being flush with a bottom surface of said stringed instrument, and;

means for removably retaining said module in said instrument cavity.

15. The interchangeable module of claim 14 wherein said cavity includes a perimeter defining a shape and said module base plate is of substantially the same shape as said cavity.

16. The interchangeable module of claim 14 wherein said housing is snap mounted on said base plate.

* * * * *